US010384241B2

(12) United States Patent
Lokkinen

(10) Patent No.: US 10,384,241 B2
(45) Date of Patent: Aug. 20, 2019

(54) DEVICE FOR CLEANING INNER SURFACE OF PIPE

(71) Applicant: Picote Solutions Oy Ltd., Porvoo (FI)

(72) Inventor: Mika Lokkinen, Porvoo (FI)

(73) Assignee: Picote Solutions Oy Ltd., Porvoo (FI)

( * ) Notice: Subject to any disclaimer, the term of this patent is extended or adjusted under 35 U.S.C. 154(b) by 132 days.

(21) Appl. No.: 15/562,532

(22) PCT Filed: Mar. 31, 2016

(86) PCT No.: PCT/FI2016/050203
§ 371 (c)(1),
(2) Date: Sep. 28, 2017

(87) PCT Pub. No.: WO2016/156668
PCT Pub. Date: Oct. 6, 2016

(65) Prior Publication Data

US 2018/0104727 A1 Apr. 19, 2018

(30) Foreign Application Priority Data

Apr. 2, 2015 (FI) ..... 20155237

(51) Int. Cl.

| | |
|---|---|
| ***B08B 9/04*** | (2006.01) |
| ***B08B 9/043*** | (2006.01) |
| ***A46B 13/00*** | (2006.01) |
| ***A46D 1/00*** | (2006.01) |
| ***B08B 9/045*** | (2006.01) |
| ***B24D 13/10*** | (2006.01) |
| ***B24B 5/40*** | (2006.01) |
| ***E03F 9/00*** | (2006.01) |

(Continued)

(52) U.S. Cl.
CPC ..... *B08B 9/0436* (2013.01); *A46B 13/003* (2013.01); *A46D 1/0207* (2013.01); *A46D 1/0253* (2013.01); *B08B 9/045* (2013.01); *B24B 5/40* (2013.01); *B24B 27/033* (2013.01); *B24D 13/02* (2013.01); *B24D 13/10* (2013.01); *E03F 9/005* (2013.01); *A46B 2200/3013* (2013.01); *A46B 2200/3093* (2013.01)

(58) Field of Classification Search
CPC ..... B08B 9/0436
See application file for complete search history.

(56) References Cited

U.S. PATENT DOCUMENTS

| | | | |
|---|---|---|---|
| 4,795,495 | A | 1/1989 | Dobson, Sr. |
| 2004/0099405 | A1 | 5/2004 | Hardy |
| 2005/0132516 | A1 | 6/2005 | Hardy et al. |

FOREIGN PATENT DOCUMENTS

| | | |
|---|---|---|
| DE | 10113395 | 8/2002 |
| DE | 202010003125 | 6/2010 |

*Primary Examiner* — Mikhail Kornakov
*Assistant Examiner* — Ryan L. Coleman
(74) *Attorney, Agent, or Firm* — Fasth Law Offices; Rolf Fasth

(57) ABSTRACT

The device is for cleaning the inner surface of a pipe. The device has a spindle arranged to be rotated and having a front end and a rear end between which a plurality of elastic metal blades are attached both in the rotation direction of the spindle and in the direction perpendicular to the rotation direction to clean the inner surface of the pipe. The blades has a shape that is curved at at least two points such that they curve at least once towards the circumferential direction of the spindle and at least once outwards from the circumferential direction of the spindle to prevent the device from getting stuck in uneven pipe systems.

8 Claims, 4 Drawing Sheets

(51) Int. Cl.
*B24B 27/033* (2006.01)
*B24D 13/02* (2006.01)

DEVICE FOR CLEANING INNER SURFACE OF PIPE

PRIOR APPLICATIONS

This is a US national phase patent application that claims priority from PCT/FI2016/050203 filed 31 Mar. 2016, that claims priority from Finnish Patent Application No.

BACKGROUND OF THE INVENTION

The invention relates to cleaning pipes and particularly to cleaning inner surfaces of used sewage pipes.

Instead of uncovering the pipes and replacing them with new ones, sewage pipes at the end of their life cycle can often be renovated without opening structures. Renovation requires that the existing pipe be carefully cleaned to remove blockages, dirt and rust before a coating or a renovation lining to be installed in the renovation can be installed in an old pipe. Pipes to be renovated are typically several decades old and there may be significant damages in them, such as cracks, splits, missing pieces and poor joints. In some cases, even the entire pipe bottom has worn off and in the soil under the pipe, a small ditch has been formed where sewage waste is flowing. Despite damages, renovation can be successfully carried out by using a renovation lining but the damages in the pipe make cleaning difficult.

Finnish utility model publication FI10735 discloses a technique for cleaning the inner surface of sewage pipe systems, in use at least since the 1940s. The publication discloses a cleaning device consisting of chains the loops of which are provided with welded or soldered hard metal blades. The chains are rotated in the pipe system, whereby the hard metal blades grind the inner surface of the pipe.

A problem with the above arrangement is that chains get stuck at the damaged points of the pipe when the hard metal blades in the chain push into cracks, joints or the like damaged points. It is difficult to remove a stuck chain without breaking the pipe more, particularly when the chain gets stuck in a portion after several bends. Even if the chain did not get stuck when a larger piece is missing from a pipe, the hard metal blades in the chain have sharp edges and they are protruding, so they hit the sharp edge of a larger opening with force, which makes the rotation of the chain stop and may cause the chain-rotating cable to break. In addition to the operational problems, it is laborious to manufacture above-described chains as, in practice, they must be welded manually, whereby the manufacture is slow and labour-intensive. Repairing a chain due to the wearing of hard metal blades is almost as laborious as making a completely new chain, so it is not profitable.

In cleaning the inside of sewage pipes, high-pressure injection of water can also be used but the cleaning result is not perfect. Rust removal, in particular, is difficult by injecting water. Furthermore, in the case of larger damaged points, for instance when the pipe bottom has worn off, the injected water runs out of the damaged point, causing further damage.

As a third alternative, a rotatable spindle has been used for cleaning the inside of pipes, the spindle having abrasive, flexible strips or flexible strips provided with blades. A problem with abrasive strips is that they get clogged fast, whereby their abrasive properties disappear and the strip needs to be replaced with a new one. Blades used in strips solve the clogging problem but they have problems with damaged points, similar to those of chains. The blade in a strip may get stuck in a crack, pipe joint or cleft, and when a larger piece is missing from the pipe, the fastening point of the blade hits the edge of the damaged point and breaks the blade, strip, cable or pipe.

Brief description of the invention

An object of the invention is thus to provide a device that solves the above-mentioned problems. The object of the invention is achieved by a method and system which are characterized by what is disclosed in the independent claims. Preferred embodiments of the invention are disclosed in the dependent claims.

The invention is based on the idea that a rotatable spindle is provided with a plurality of elastic blades shaped such that they smoothly guide the device away from large openings having formed in the pipe system, whereby the blades do not get stuck in the irregularities of the pipe system.

Advantages of the method and system according to the invention include an efficient cleaning effect and high reliability even in badly damaged pipe systems.

BRIEF DESCRIPTION OF THE FIGURES

The invention is now described in closer detail in connection with preferred embodiments and with reference to the accompanying drawings, in which.

DETAILED DESCRIPTION OF THE INVENTION

Figure 1:
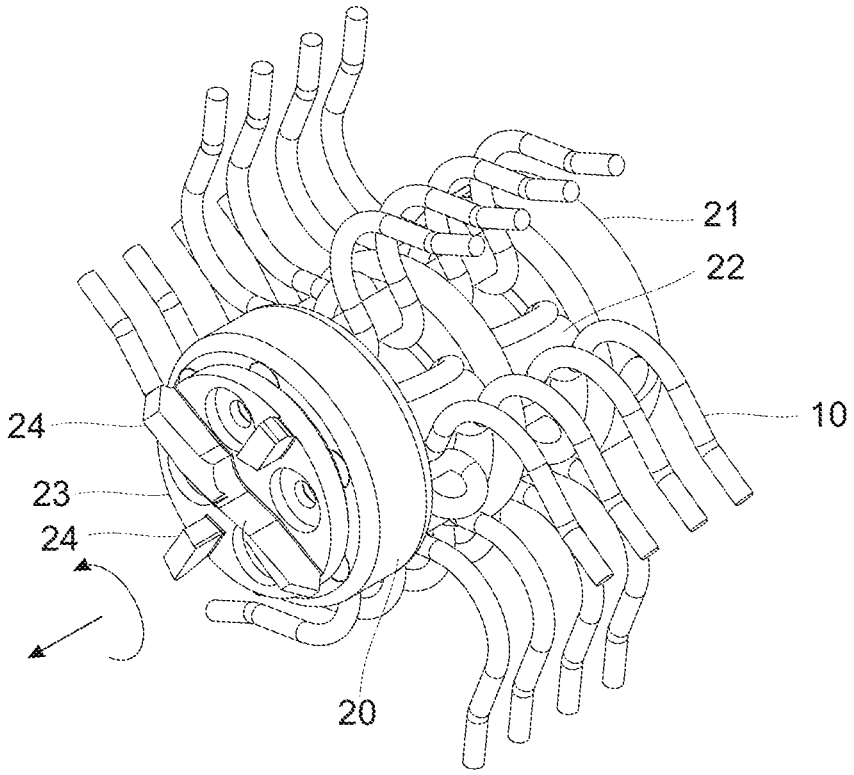
FIG. 1 shows a device according to an embodiment of the invention.
Figure 3:
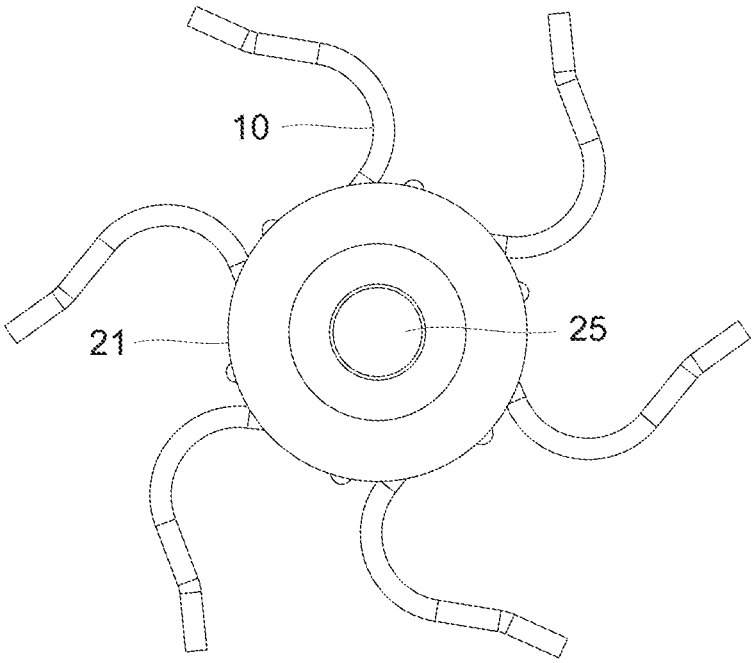
FIG. 3 shows a device according to an embodiment of the invention in the direction of the rotation axis, seen from the rear end of the device.
Figure 5:
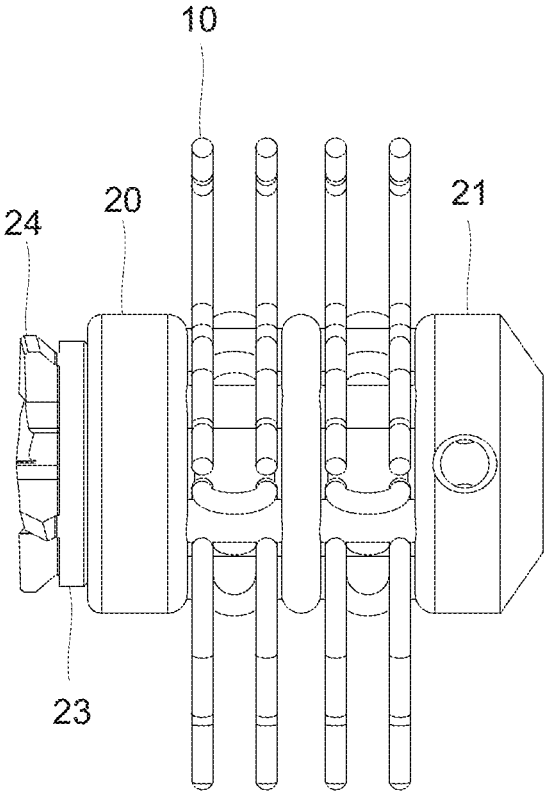
FIG. 5 shows a device according to an embodiment of the invention in the direction perpendicular to the rotation axis.

FIGS. 1, 3 and 5 show a device according to an embodiment of the invention from different viewing angles. The device is formed of a spindle arranged to be rotated and having a front end 20 and a rear end 21. Preferably, the front end and the rear end have annular cross-sections, their diameter being preferably larger than the spindle part between them. The spindle has means for fastening a rotating shaft to the spindle. Preferably, the spindle has a cavity in the middle to receive the rotating shaft, the cavity 25 extending at least through the rear end in order for the rotating shaft to be brought into the cavity from the rear end of the device relative to the direction of travel. The direction of travel and the direction of rotation are indicated by arrows in FIG. 1. The spindle preferably has one or more threaded openings extending from the outer surface of the spindle into the cavity, whereby a retainer screw screwed to the opening allows the rotating shaft to be fastened to the spindle of the device.

Between the front end 20 and rear end 21 of the spindle, there are preferably pins 22 which allow blades 10 to be attached to the device. The pins can be detached from the device, whereby the blades fastened with them are released and can be replaced with new ones if they are, for instance, worn, damaged or of the wrong size with respect to the pipe to be cleaned. Preferably, the pins are bolts or screws extending from the front end 20 to the rear end 21, whereby they can be easily and quickly detached and attached by screwing by the end. Thus, the blades can be replaced with new ones by the user any time, and after that the work can be continued immediately. In this case, preferably, only the required parts of the pins 22 are threaded, the other parts having an even surface. It is also feasible to use alternative ways of fastening for the blades. For example, in an embodiment, the spindle comprises openings or slots to which blades can be attached, for instance by using retainer screws. In one embodiment, the blades are attached to the spindle with screws or bolts.

Between the front end 20 and the rear end 21 of the spindle, a plurality of blades 10 are attached both in the rotation direction of the spindle and in the direction perpendicular to it, whereby the blades, when being rotated in the pipe, clean the inner surface of the pipe while scraping it. In the rotation direction, there may be two or more blades, preferably four to ten blades, for example six or eight blades. In the direction perpendicular to the rotation direction, there may be two or more blades, preferably two to ten blades, for example three, four, six or eight blades. Preferably, more blades are used for larger inner diameters of the pipe to be cleaned than for smaller inner diameters of the pipe to be cleaned.

The blades 10 are partially or preferably completely of metal. The blades 10 are elastic, returning to their shape after minor bending. The blades have preferably such elasticity that when the device is being rotated at conventional rotation speeds intended for cleaning, for instance in the range of 500 to 4 000 revolutions per minute or 1 000 to 3 000 revolutions per minute, the elasticity of the blades makes the device bounce in the pipe when the blades bend and return to their shape. Bouncing of the device in the pipe improves the cleaning efficiency of the device, subjecting the inner surface of the pipe system to numerous smallish impacts and efficiently detaching the dirt and rust gathered in the pipe system. Preferably, the blades are made of spring steel, which is preferably tempered to increase hardness. At those points of the blades which hit the inner surface of the pipe, i.e. at the outermost end as seen from the spindle, there is preferably a cut surface, whereby the point hitting the inner surface of the pipe is the sharp edge of the cut surface. At these points, it is also feasible to use one or more hard metal pieces fastened to the blade by, for instance, welding or soldering, the piece having a hardness and abrasion resistance which are better than those of other steel material. At the points of the blades that hit the inner surface of the pipe, it is also feasible to use coatings which improve the abrasion resistance of the steel or increase the cleaning effect.

Figure 7:
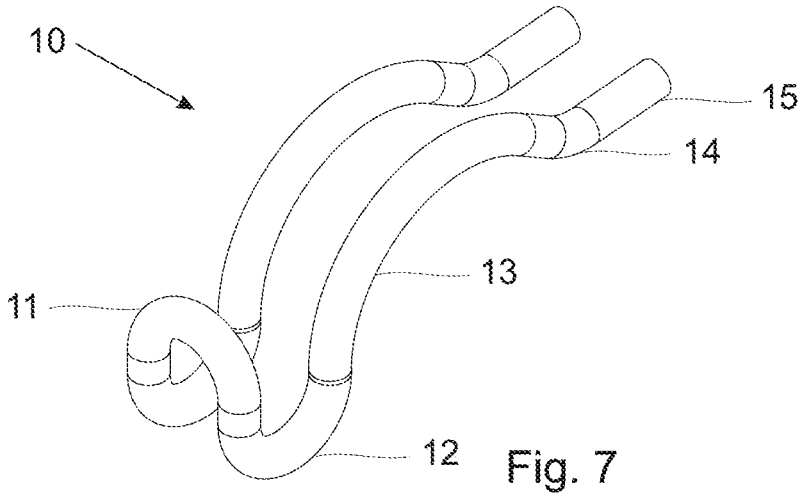
FIG. 7 shows a blade of a device according to an embodiment of the invention.
Figure 8:
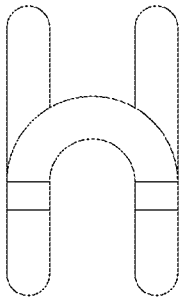
FIG. 8 shows a blade of a device according to an embodiment of the invention in the direction perpendicular to the rotation axis of the device.
Figure 9:
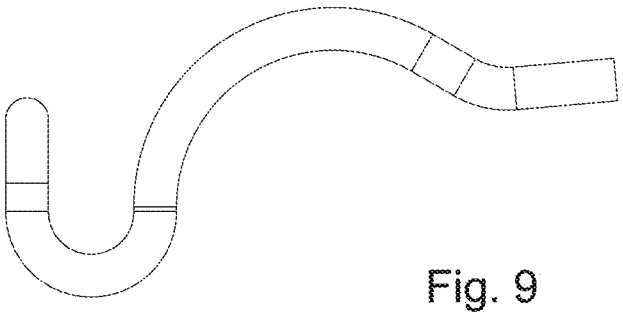
FIG. 9 shows a blade of a device according to an embodiment of the invention in the direction of the rotation axis of the device.

FIGS. 7, 8 and 9 show a blade of a device according to an embodiment of the invention from different viewing angles. The blades 10 fastened to the device by means of pins, for example, are shaped in such a way that the shaping of the blades prevents the device from getting stuck or going through intense impacts when the device is being rotated in the damaged pipe. To achieve this desired effect, the shape of the blades 10 is curved at at least two points. The blades 10 curve at least once towards the circumferential direction 13 of the spindle and at least once outwards from the circumferential direction 14 of the spindle to prevent the device from getting stuck in uneven pipe systems. Owing to the shaping of the blades, a blade of the device, when hitting a damaged point in a pipe, for instance a slot in the pipe, gets into contact with the pipe edge at a gentle angle in a dragging manner, whereby the device exits the slot controllably without causing too great an impact to the pipe or the cleaning equipment. In an embodiment, the blades 10 are made of a wire which is bent, at a middle point 11, into the shape of letter U such that the portions remaining between the middle bend 11 and open ends 15 are parallel. Said parallel portions comprise a bend into a hook 12 to attach the blade to the spindle. The hook may be bent inwards or bent outwards, as shown in FIGS. 7, 8 and 9. In addition to an open hook shape having almost the shape of letter U, the hook may open more or less, or instead of being bent as a hook, the blade may be bent as a loop by which the blade can be attached to the device, for instance to the pins between the front end and rear end of the spindle. Said parallel portions further comprise a bend in the circumferential direction 13 of the spindle to increase the tolerance of unevenness of the pipe system by making the angle at which the blade comes into contact with the possible unevenness and irregularities in the pipe system gentler. Further, said parallel portions comprise a bend outwards 14 from the circumferential direction of the spindle to make the open end 15 get into contact with the surface to be cleaned. The open ends of the blade are preferably cut straight, so that the blade has a sharp edge which, when scraping the inner surface of the pipe, cleans it efficiently. The use of the presented two-ended blade 10 effectively prevents the blades of the device from getting stuck to the damaged points and other irregularities of the pipe system. It is nearly impossible for one end to sink into a narrow crack or slot by itself because the other end prevents it from getting deeper. When both ends get stuck to a hole, the arms of the blade bend and cause the blades to be lightly detached when pulled. If both blades get into a narrowing hole, a blade bends and the ends get closer to each other but if the hole is not precisely at the location of the blade, one side of the blade bends more and begins to wrench the device into a slanting position, detaching the device from the narrowing groove and preventing the blades from pushing into the groove.

Figure 2:
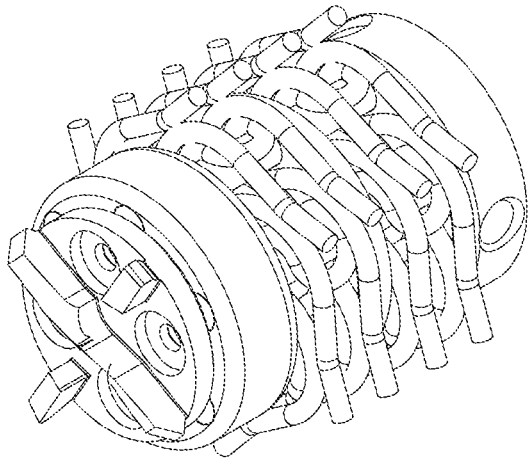
FIG. 2 shows a device according to an embodiment of the invention when the blades are turned close to the spindle.
Figure 4:
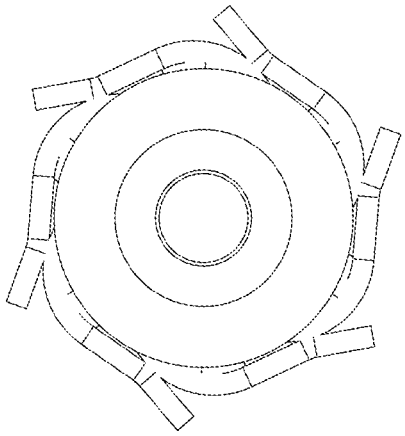
FIG. 4 shows a device according to an embodiment of the invention in the direction of the rotation axis, seen from the rear end of the device when the blades are turned close to the spindle.
Figure 6:
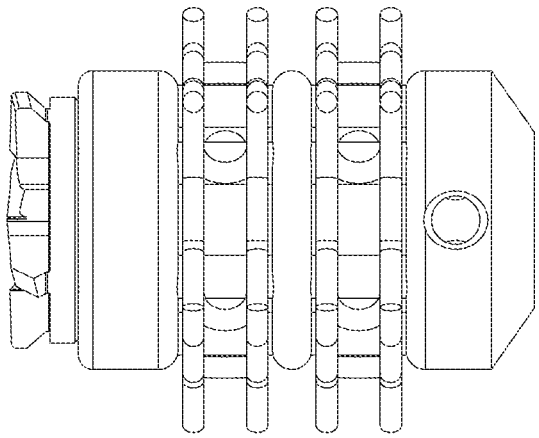
FIG. 6 shows a device according to an embodiment of the invention in the direction perpendicular to the rotation axis when the blades are turned close to the spindle.

FIGS. 2, 4 and 6 show a device according to an embodiment, wherein the blades are attached to the spindle in a pivoted or hinged manner, for example by means of pins described above. Said pivoted or hinged joint allows the blades 10 to turn in the rotation direction of the spindle, whereby the blades can move between the open position shown in FIG. 1 and the closed position shown in FIG. 2. However, said joint prevents the blades from turning in the direction perpendicular to the rotation direction, whereby the cleaning efficiency remains good. The spindle may be provided with fixed or adjustable protrusions which allow the blade to have a turning angle of a desired size. In an embodiment, protrusions may be used which allow the blades to turn for instance 20, 30, 40, 50 or 60 degrees from the closed position in which the blades touch the adjacent blade. When the device is being rotated at typical rotation speeds used for cleaning, the blades open due to the effect of the rotation movement, and the blade ends 15 hit the inner surface of the pipe. When being rotated very slowly or with short impulses, the device fits in narrower pipes and bending points of a pipe system to travel to the object to be cleaned, which may have a larger inner diameter than the pipe through which the device is brought to the object. In an embodiment, protrusions may be used which prevent the blades from turning completely, whereby the positioning of the blades remains constant.

In an embodiment, the device comprises for instance a milling plate 23 fastened to the front end 20 or arranged to be fastened to it. The milling plate has one or more milling cutters 24 which make it possible to efficiently remove blockages in the pipe system, such as tree roots that have pushed into the pipe system, by grinding, after which it is easy to remove the blockages from the pipe by flushing, for example. The milling plate 24 and its cutters 23 rotate along with the spindle when the spindle is being rotated, and they grind the material they encounter in the pipe system in the direction of travel when the device is being pushed onwards in the pipe system via the rotating shaft. The milling plate 23 is preferably attachable to the spindle and detachable from the spindle by means of screws, for instance, whereby the device can be used with or without a milling plate, depending on the object to be cleaned.

It is apparent to a person skilled in the art that as technology advances, the basic idea of the invention may be implemented in many different ways. The invention and its embodiments are thus not restricted to the examples described above but may vary within the scope of the claims.

While the present invention has been described in accordance with preferred compositions and embodiments, it is to be understood that certain substitutions and alterations may be made thereto without departing from the spirit and scope of the following claims.

I claim:

1. A device for cleaning the inner surface of a pipe, the device comprising:

a spindle arranged to be rotated and having a front end and a rear end as well as means for fastening a rotating shaft to the spindle, whereby a plurality of wire metal blades are attached between the front end and the read end of the spindle both in a rotation direction of the spindle and in the direction perpendicular to the rotation direction to clean the inner surface of the pipe, the blades each having a shape that is curved at least two points such that each blade curves at least once towards the circumferential direction of the spindle and at least once outwards form the circumferential direction of the spindle to prevent the device from getting stuck in uneven pipe systems, the blades being attached to the spindle in a pivoted manner such that rotation of the spindle can cause the attached blades to pivot in the rotation direction of the spindle.

2. The device according to claim 1, wherein the blades are arranged to be attached to the spindle with detachable pins between the front end and the rear end of the spindle, the blades being detachable and replaceable by detaching said pins.

3. The device according to claim 1, wherein the spindle is provided with pins between the front end and the rear end of the spindle, the blades being attached to said pins by a hook or a loop in the blades.

4. The device according to claim 1, wherein the blades of the device are made of tempered spring steel.

5. The device according to claim 1, wherein the blades of the device are made of wire bent in the middle, whereby portions between a middle bend and open ends are parallel and comprise a bend into a hook, a bend in the circumferential direction of the spindle to increase the tolerance of unevenness of the pipe system, and a bend outwards from the circumferential direction of the spindle.

6. The device according to claim 1, wherein each blade comprises a hard metal piece at the outermost end of the blade, seen from the spindle.

7. The device according to claim 1, wherein the device comprises a milling plate arranged to be fastened to the front end of the spindle and comprising one or more milling cutters to grind blockages in the pipe system in the direction of travel of the device when the device is being pushed onwards in the pipe system.

8. A method of using the device according to claim 1 for cleaning the inner surface of a sewage pipe system, wherein the method comprises rotating the spindle in the pipe system such that the blades scrape against inner surfaces of the pipe system.

* * * * *